US009972433B2

(12) United States Patent
Yang et al.

(10) Patent No.: US 9,972,433 B2
(45) Date of Patent: May 15, 2018

(54) MULTIPLE WINDING TRANSFORMER

(71) Applicant: LITE-ON TECHNOLOGY CORP., Taipei (TW)

(72) Inventors: Te-Hong Yang, Taipei (TW); Ming-Tsung Hsieh, Taipei (TW); Po-Jung Tseng, Taipei (TW); Yu-Kang Lo, Taipei (TW)

(73) Assignee: Lite-On Technology Corp., Taipei (TW)

( * ) Notice: Subject to any disclaimer, the term of this patent is extended or adjusted under 35 U.S.C. 154(b) by 47 days.

(21) Appl. No.: 15/154,101

(22) Filed: May 13, 2016

(65) Prior Publication Data

US 2017/0062123 A1 Mar. 2, 2017

(30) Foreign Application Priority Data

Aug. 28, 2015 (CN) ..... 2015 2 0661867 U

(51) Int. Cl.
*H01F 27/30* (2006.01)
*H01F 27/28* (2006.01)
*H01F 27/32* (2006.01)

(52) U.S. Cl.
CPC ..... *H01F 27/306* (2013.01); *H01F 27/2828* (2013.01); *H01F 27/325* (2013.01)

(58) Field of Classification Search
CPC ..... H01F 27/006; H01F 27/29; H01F 5/04; H01F 27/2833
USPC ..... 336/196, 198
See application file for complete search history.

(56) References Cited

U.S. PATENT DOCUMENTS 4,874,916 A * 10/1989 Burke ..... H05B 6/02 219/632
6,049,163 A * 4/2000 Masuda ..... H01F 27/06 313/318.12
7,148,779 B2 * 12/2006 Wolfgram ..... H01F 27/2823 336/180
7,446,642 B2 * 11/2008 Fang ..... H01F 17/04 336/198
9,136,054 B1 * 9/2015 Xiong ..... H01F 29/02
2011/0115598 A1 * 5/2011 Wu ..... H01F 27/325 336/212
2012/0001715 A1 * 1/2012 Taracila ..... G01R 33/365 336/200
2012/0182110 A1 * 7/2012 Pan ..... H01F 27/2847 336/170

(Continued)

FOREIGN PATENT DOCUMENTS

EP 2182533 A1 * 5/2010 ..... H01F 5/04
JP 2000091134 A * 3/2000

*Primary Examiner* — Tsz Chan
(74) *Attorney, Agent, or Firm* — Rosenberg, Klein & Lee

(57) ABSTRACT

A multiple winding transformer includes a core unit, a first winding set which has N (N≥3) number of windings, and a second winding set which has at least one winding. The windings of the first winding set are overlappingly wound around the core unit. Each of the windings includes an input terminal and an output terminal. The input terminal of one of the windings is spaced apart from the input terminal of a next one of the windings by (360/N) degrees, and the input terminals are interconnected to form an input end. The output terminal of one of the windings is spaced apart from the output terminal of a next one of the windings by (360/N) degrees, and the output terminals are interconnected to form an output end.

11 Claims, 8 Drawing Sheets

(56) References Cited

U.S. PATENT DOCUMENTS

2013/0002631 A1* 1/2013 Kim ..... H01F 27/06
345/211

* cited by examiner

MULTIPLE WINDING TRANSFORMER

CROSS-REFERENCE TO RELATED APPLICATION

This application claims priority of Chinese Patent Application No. 201520661867.1, filed on Aug. 28, 2015.

FIELD

The disclosure relates to a transformer, more particularly to a multiple winding transformer.

BACKGROUND

In transformer design, the winding turn-ratio and the duty cycle of a switching power source determine the effective output power of a transformer. When the winding turn-ratio and the duty cycle are carefully designed, the conversion efficiency of the transformer can be optimized. A winding scheme of a conventional transformer usually includes an integer number of winding turns. Nevertheless, in some applications, the number of winding turns of a transformer must be non-integer for achieving an optimum efficiency design of switching modulation for a converter. The approach of a conventional transformer which has non-integer winding-turn usually leads to asymmetric distribution of the intensity of magnetic field and unbalanced magnetic flux, so that heat may result from an uneven magnetic field of a transformer core, and the overall conversion efficiency is degenerated.

SUMMARY

Therefore, an object of the disclosure is to provide a multiple winding transformer having improved conversion efficiency, and to overcome the aforementioned issues of unbalanced magnetic flux for a conventional transformer with a non-integer number of winding turns.

According to the disclosure, the multiple winding transformer includes a core unit, a first winding set including N (N≥3) number of windings and a second winding set including at least one winding. The windings of the first winding set are sequentially and overlappingly wound around the core unit. Each of the windings of the first winding set has an input terminal and an output terminal. The input terminal of one of the windings of the first winding set is spaced apart from the input terminal of a next one of the windings of the first winding set by (360/N) degrees, and the input terminals of the windings of the first winding set are interconnected to form an input end. The output terminal of one of the windings of the first winding set is spaced apart from the output terminal of a next one of the windings of the first winding set by (360/N) degrees, and the output terminals of the windings of the first winding set are interconnected to form an output end. The at least one winding of the second winding set is wound around the core unit.

In this disclosure, the N (N≥3) number of windings of the first winding set are connected in parallel and are wound around the core unit, the input terminal of one of the windings is spaced apart from the input terminal of a next one of the windings by (360/N) degrees, and the output terminal of one of the windings is spaced apart from the output terminal of a next one of the windings by (360/N) degrees. Therefore, when the number of turns of each winding of the multiple winding transformer is equal to 1/N of the winding turns of a comparative, conventional transformer and the wire diameter of each winding is kept the same as that of the comparative design, the disclosure has an effect that power consumption of the multiple wining transformer may be decreased to $1/N^2$ of the original power consumption, so the overall conversion efficiency is improved.

BRIEF DESCRIPTION OF THE DRAWINGS

Other features and advantages of the disclosure will become apparent in the following detailed description of embodiments with reference to the accompanying drawings, of which.

DETAILED DESCRIPTION

Figure 1:
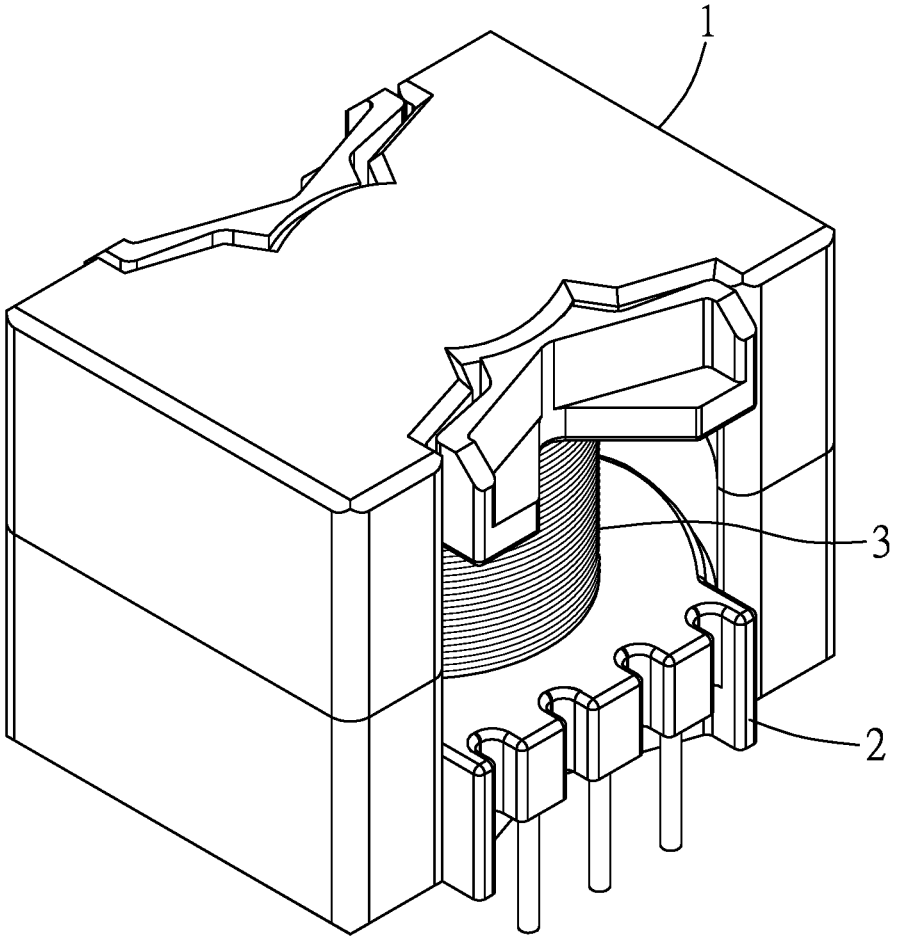
FIG. 1 is a schematic view of an exemplary implementation of a multiple winding transformer according to the disclosure.

Before this disclosure is described in greater detail with reference to the accompanying embodiments, it should be noted herein that like elements are denoted by the same reference numerals throughout the disclosure.

FIG. 1 depicts an exemplary implementation of a multiple winding transformer according to the disclosure.

Figure 2:
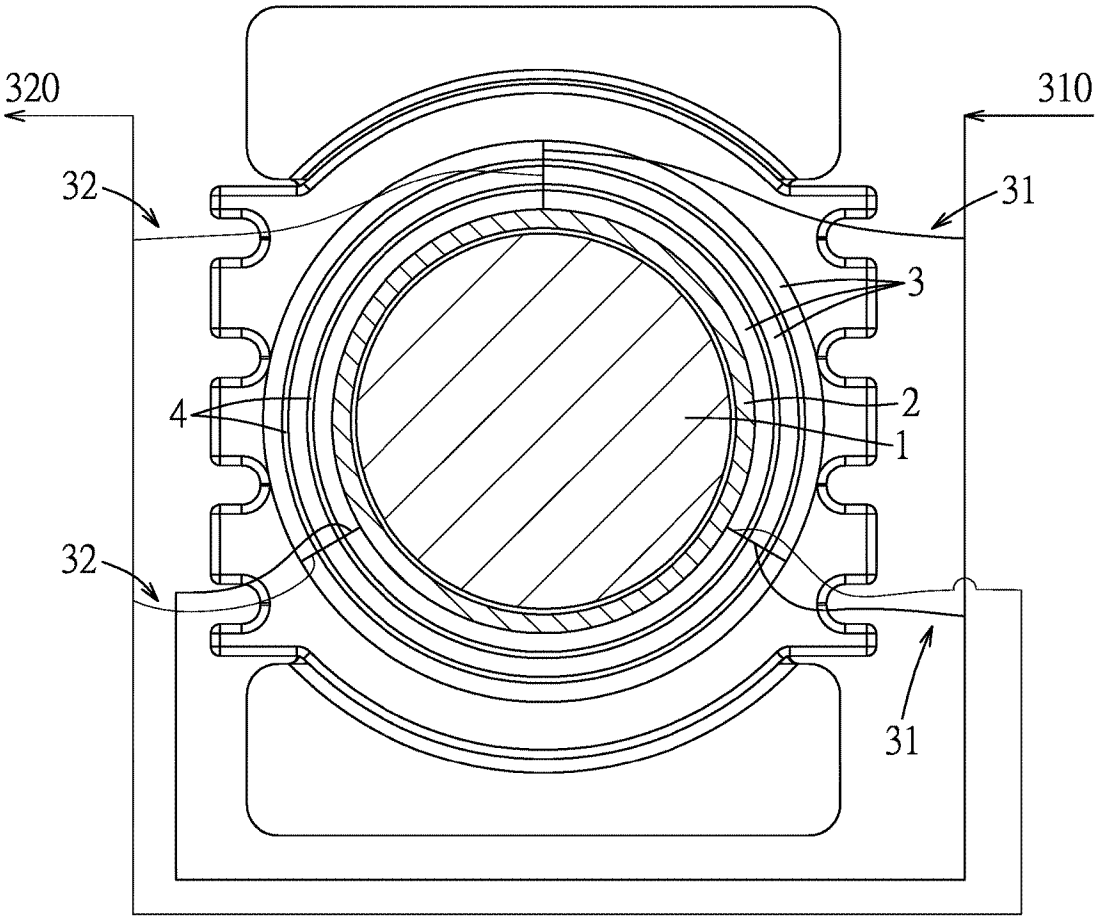
FIG. 2 is a cross sectional schematic diagram of a first embodiment of the multiple winding transformer according to the disclosure.

Referring to FIG. 2, a first embodiment of a multiple winding transformer according to the disclosure includes a core unit 1, a winding support 2 sleeved onto the core unit 1, a first winding set 3 which includes N (N≥3) number of windings, and a second winding set 4 which includes at least one winding. The core unit 1 includes two PQ-type cores which are correspondingly joined together as best shown in FIG. 1. In the first embodiment, there are three windings in the first winding set 3 (i.e., N=3). However, the windings of the first winding set 3 are not limited to totaling to three as the disclosure herein, and the number of windings of the first winding set 3 may be greater than three. There are two windings in the second winding set 4 in the first embodiment. Similarly, the number of the windings of the second winding set 4 is not limited to the disclosure herein as long as it is equal to or greater than one.

Referring to FIG. 2, the windings of the first winding set 3 are sequentially and overlappingly wound around the winding support 2. Each of the windings of the first winding set 3 includes an input terminal 31 and an output terminal 32 (each of the windings of the first winding set 3 is individually and schematically depicted in FIGS. 3 to 5 for better illustration). The input terminal 31 of one of the windings of the first winding set 3 is spaced apart from the input terminal 31 of a next one of the windings of the first winding set 3 by (360/N) degrees (i.e., 360/3=120 degrees in the first embodiment). The output terminal 32 of one of the windings of the first winding set 3 is also spaced apart from the output terminal 32 of a next one of the windings of the first winding set 3 by (360/N) degrees (i.e., 360/3=120 degrees in the first embodiment). Moreover, the input terminal 31 of one of the windings of the first winding set 3 is located adjacent to the output terminal 32 of another one of the windings of the first winding set 3, and the output terminal 32 of said one of the windings of the first winding set 3 is located adjacent to the input terminal 31 of still another one of the windings of the first winding set 3.

Figure 3:
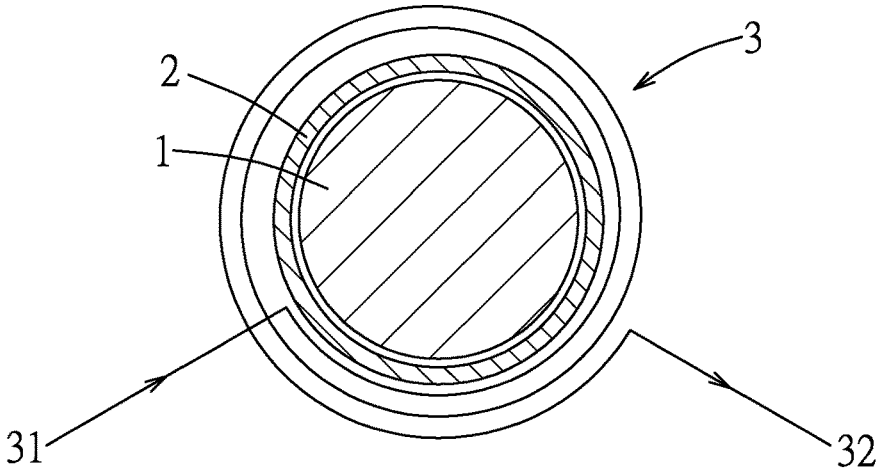
FIG. 3 is a cross sectional schematic diagram illustrating a winding of the first winding set of the first embodiment.
Figure 4:
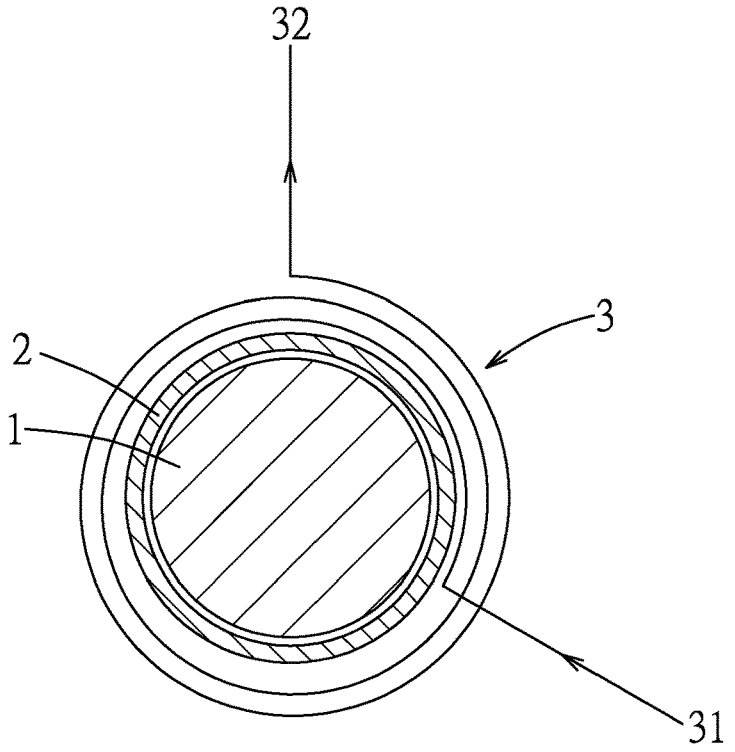
FIG. 4 is a cross sectional schematic diagram illustrating another winding of the first winding set of the first embodiment, and this winding is next to the winding depicted in FIG. 3.
Figure 5:
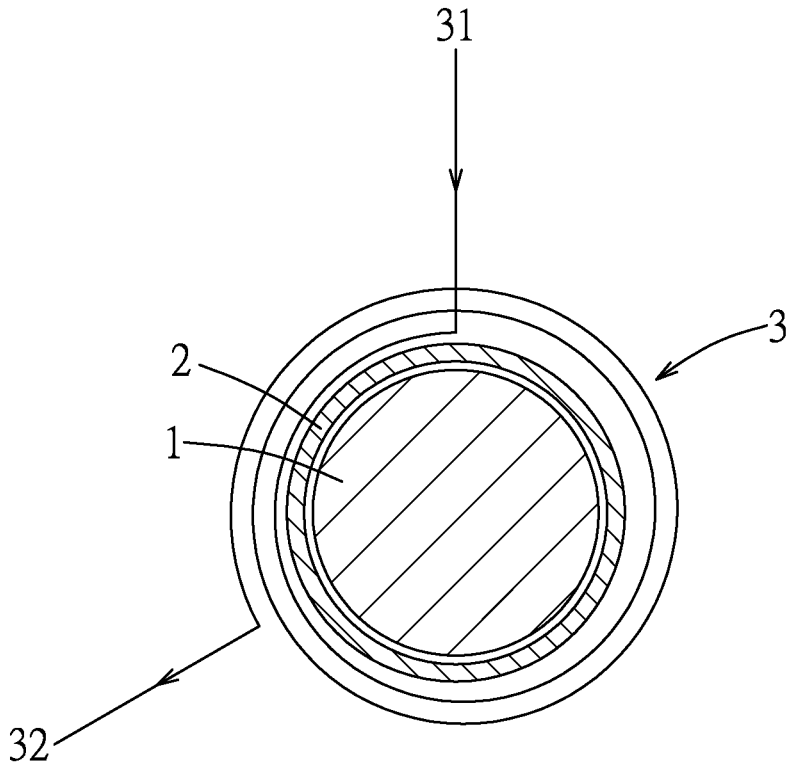
FIG. 5 is a cross sectional schematic diagram illustrating still another winding, which is next to the winding in FIG. 4, of the first winding set of the first embodiment.

Referring to FIG. 3 to FIG. 5, the input terminal 31 and the output terminal 32 of each of the windings of the first winding set 3 are spaced apart from each other by (360/N) degrees (i.e., 360/3=120 degrees in the first embodiment). Referring back to FIG. 2, the second winding set 4 and the first winding set 3 are wound around the core unit 1 in a manner of layering the windings of the second winding set 4 and the windings of the first winding set 3 alternately onto the core unit 1. Referring to FIG. 2, the first winding set 3 and the second winding set 4 cooperate to form a 5-layer structure in the first embodiment. In an outward direction, the winding set 3 and the winding set 4 are arranged in the order of one of the windings of the first winding set 3 (innermost layer), one of the windings of the second winding set 4, another one of the windings of the first winding set 3, the other one of the windings of the second winding set 4, and the remaining one of the windings of the first winding set 3 (outermost layer). By means of this layered winding structure, the multiple winding transformer of this disclosure may have the following advantages. First, the leakage inductance of the multiple winding transformer may be reduced, and parasitic element characteristics of the multiple winding transformer may be optimized. Second, magnetomotive force between layers may be reduced so as to reduce eddy-current loss and copper loss. Third, heat generated by copper wires may be dispersed.

It should be noted that, in this embodiment, the first winding set 3 serves as the primary winding of the multiple winding transformer, and the second winding set 4 serves as the secondary winding of the multiple winding transformer. However, it is also viable that the first winding set 3 servers as the secondary winding of the multiple winding transformer, and the second winding set 4 servers as the primary winding of the same. When a transformer is required to operate under this condition, where input voltage at a primary winding side is 70V and an output voltage at a secondary winding side is 60V, it may be derived from a known transformer theory that the turns-ratio of primary winding to secondary winding should be 7:6. The primary winding having the number of winding turns of seven, and the secondary winding having the number of winding turns of six will be a comparative example for matching our design. In this embodiment, when the numbers of winding turns of the primary winding and secondary winding are respectively reduced to 1/3 of the numbers of winding turns in the comparative example, the turns-ratio becomes (7/3):2. How to arrange three of such "two and one-third turns" windings on the primary winding side of the multiple winding transformer is explained hereinafter.

Referring to FIG. 3 to FIG. 5, a winding approach of all of the three windings of the first winding set 3 is given as an example for explanation. One end (i.e., the input terminal 31) of a winding of the first winding set 3, approaches the winding support 2, is then wound around the winding support 2 from a starting point by wrapping two and one-third turns around the winding support 2 (i.e., 840 degrees), and leaves the winding support 2 to form the output terminal 32. The other two windings of the first winding set 3 at the other two layers are wound around the winding support 2 in the same manner. However, the three input terminals 31 are spaced apart from each other by 120 degree. Similarly, all of the output terminals 32 are spaced from each other by 120 degrees. The input terminals 31 of the respective three windings of the first winding set 3 are interconnected to form an input end 310 (see FIG. 2), and the output terminals 32 of the respective three windings of the first winding set 3 are interconnected to form an output end 320 (see FIG. 2). The input end 310 and the output end 320 will be the primary side of the multiple winding transformer. That is to say, the three windings of the first winding set 3 are connected in parallel. Accordingly, wrapping of the three windings (each having 7/3 turns) of the first winding set 3 is accomplished. In this way, both the non-integer turn-ratio and symmetric distribution of the intensity of magnetic field are attainable, so the effects of balanced magnetic flux and reduced power consumption are achieved by such windings.

Further to the aforementioned example where a single winding having seven turns is modified to three windings of the first winding set 3, each having 7/3 turns. The electrical resistance of the single winding, which has seven turns, is denoted by R and an input electric current inputted to this single winding is denoted by I, the power consumption of this single winding is equal to $I^2R$. On the other hand, when the three windings of the first winding set 3, each of which has 7/3 turns, substitute the single winding which has 7 turns, under such a circumstance that the input electric current is the same, an electric current flowing through each of the windings of the first winding set 3 is equal to 1/3, electrical resistance of each of the windings is now equal to R/3, and the total power consumption of the three windings of the first winding set 3 is calculated as follows:

$$3\times\left[\left(\frac{I}{3}\right)^2\times\left(\frac{R}{3}\right)\right]=\frac{I^2R}{9}.$$

It is evident that when the three windings of the first winding set 3 substitute the single winding of the conventional transformer, and the turns-ratio is reduced to one third of the turns-ratio of the comparative example, under the same input electric current, the power consumption of the first embodiment of the multiple winding transformer is reduced to one-ninth of that of the conventional transformer (i.e., the comparative example). The power consumption of the multiple winding transformer is significantly reduced, and an overall energy conversion efficiency is improved.

It should be noted that, in the first embodiment, the multiple winding transformer of the disclosure is designed as a step-down transformer. However, the multiple winding transformer, in other embodiments, may be designed as a step-up transformer. For example, the input voltage at the primary side is 60V, and the output voltage at the secondary side is 70V. It may be derived from the known transformer theory that the turn-ratio of primary winding to secondary winding should be 6:7. When the number of turns of primary winding and secondary winding is reduced to 1/3 of the original number of turns, the turn-ratio becomes 2:(7/3). In this case, the first winding set 3 serve as the secondary side of the multiple winding transformer, and the second winding set 4 serve as the primary side of the same. In this way, effects similar to those of the step-down transformer may be achieved. When the number of turns of each of the windings of the first winding set 3 and each of the windings of the secondary winding set 4 is reduced to 1/3 of the conventional number of turns, the power consumption of the multiple winding transformer may be reduced to one-ninth of that of the conventional transformer, so as to significantly reduce the power consumption and to improve the overall energy conversion efficiency.

Figure 6:
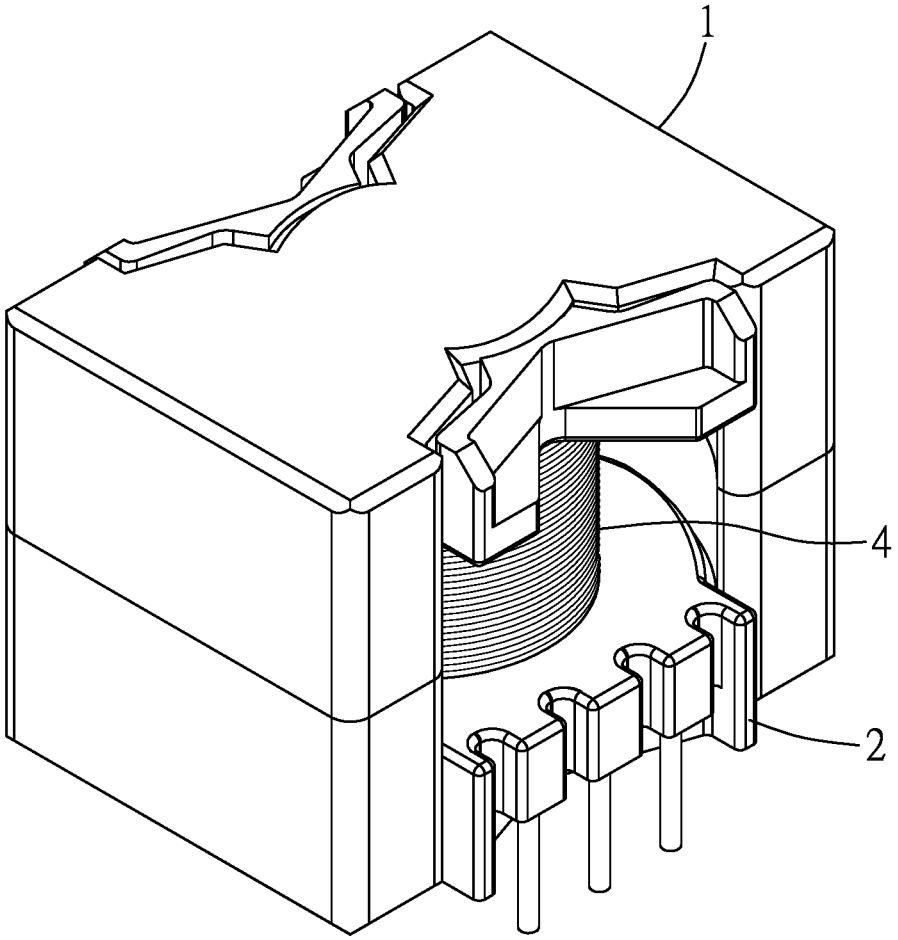
FIG. 6 is a schematic view of another exemplary implementation of the multiple winding transformer according to the disclosure.

FIG. 6 depicts another exemplary implementation of a multiple winding transformer according to the disclosure.

Figure 7:
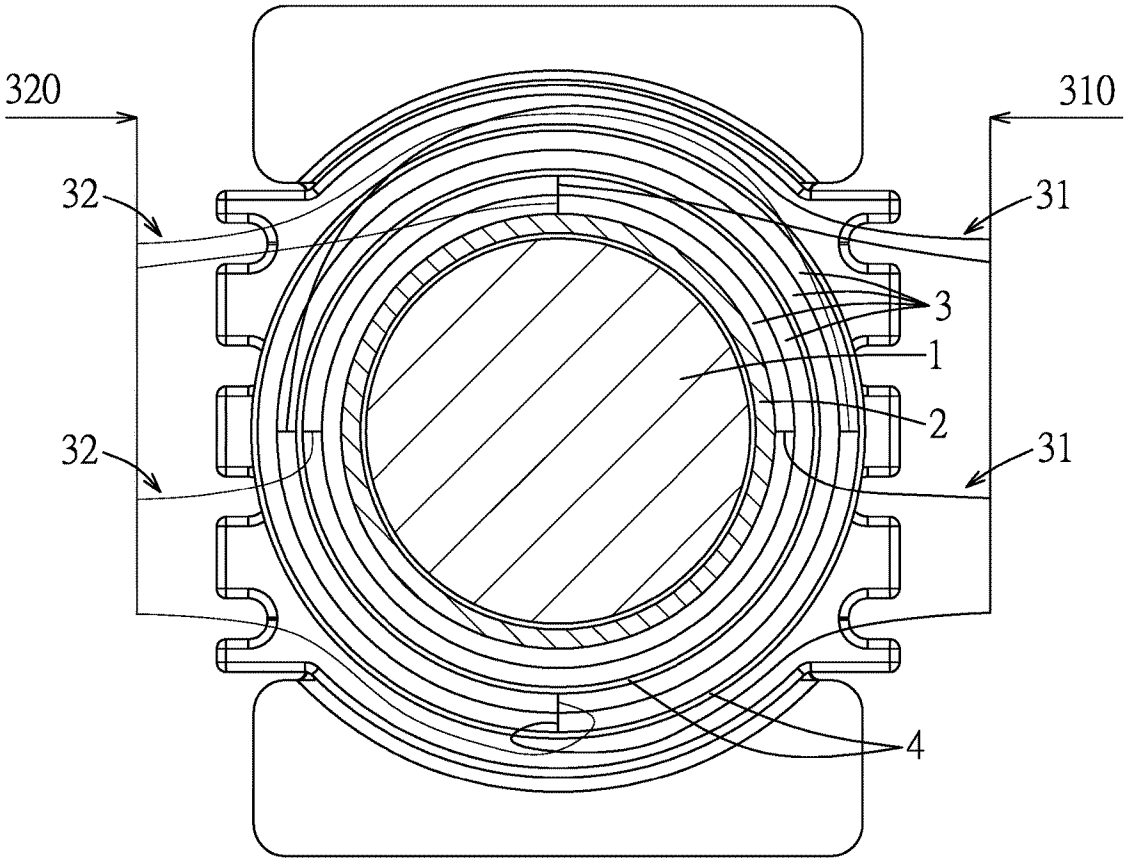
FIG. 7 is a cross sectional schematic diagram of a second embodiment of the multiple winding transformer according to the disclosure.
Figure 8:
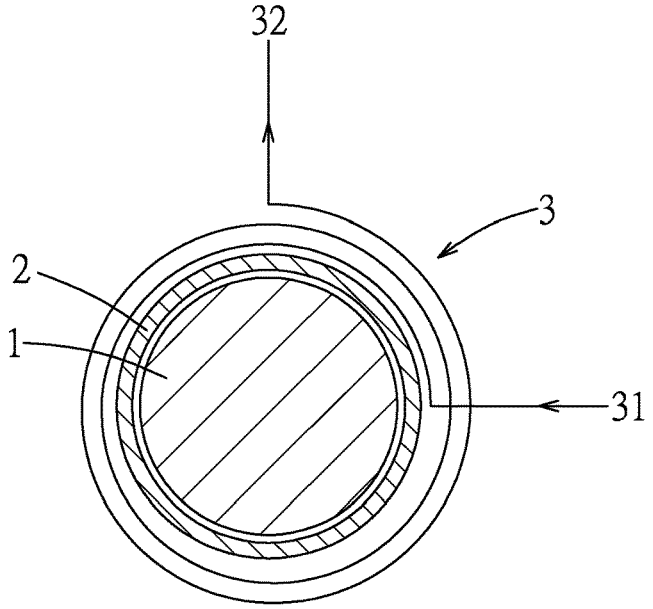
FIG. 8 is a cross sectional schematic diagram illustrating a winding of the first winding set of the second embodiment.
Figure 9:
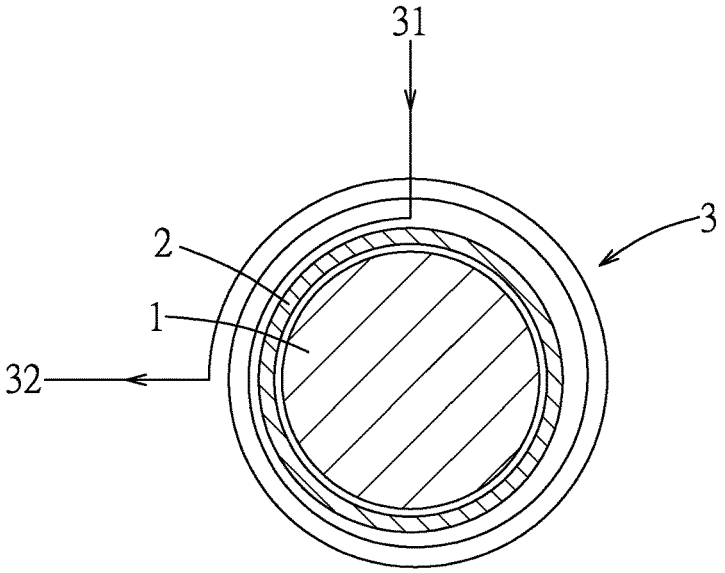
FIG. 9 is a cross sectional schematic diagram illustrating another winding of the first winding set of the second embodiment, and this winding is next to the winding depicted in FIG. 8.
Figure 10:
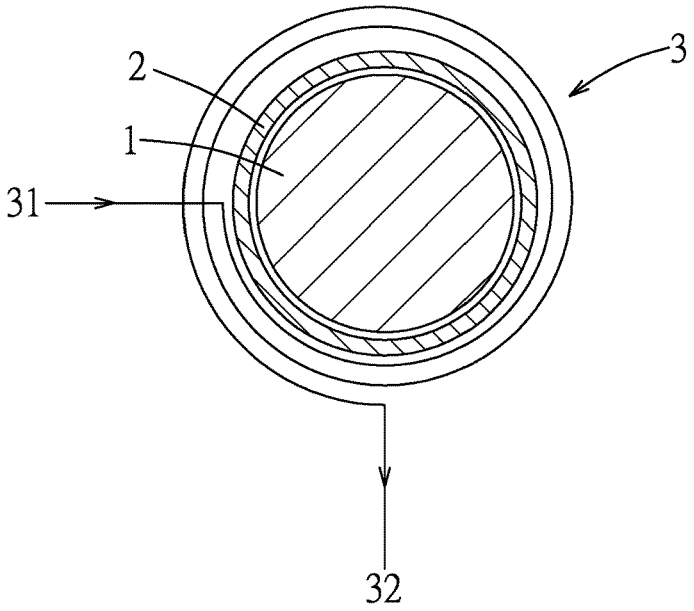
FIG. 10 is a cross sectional schematic diagram illustrating yet another winding of the first winding set of the second embodiment, and this winding is next to the winding depicted in FIG. 9.
Figure 11:
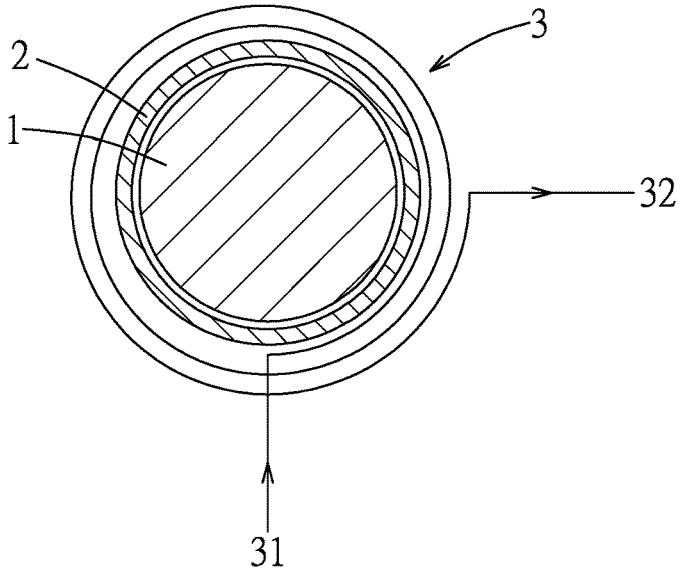
FIG. 11 is a cross sectional schematic diagram illustrating still another winding of the first winding set of the second embodiment, and this winding is next to the winding depicted in FIG. 10.

Referring to FIG. 7, a second embodiment of the multiple winding transformer according to the disclosure is similar to the first embodiment, and differs from the first embodiment in the following: the number of the windings in the first winding set 3 is four (i.e., N=4), the input terminal 31 of one of the windings of the first winding set 3 is spaced apart from the input terminal 31 of a next one of the windings of the first winding set 3 by 90 degrees (i.e., 360/N=90 degrees), and the output terminal 32 of one of the windings of the first winding set 3 is spaced apart from the output terminal 32 of a next one of the windings of the first winding set 3 by 90 degrees (i.e., 360/N=90 degrees).

Referring to FIG. 8 to FIG. 11, for each of the windings of the first winding set 3, the input terminal 31 and the output terminal 32 of the winding are spaced apart by 90 degrees (i.e., 360/N=90 degrees). Referring to FIG. 7, the windings of the first winding set 3 and the windings of the second winding set 4 are layered so as to cooperate to form a 6-layer structure. In an outward direction, the order from an innermost layer to an outermost layer is as follows: one of the windings of the first winding set 3, another one of the windings of the first winding set 3, one of the windings of the second winding set 4, yet another one of the windings of the first winding set 3, the remaining one of the windings of the first winding set 3, and the other one of the windings of the second winding set 4. The 6-layer structure, in an order from inside to outside, includes two winding layers of the first winding set 3, one winding layer of the second winding set 4, two winding layers of the first winding set 3 and one winding layer of the second winding 4.

When a transformer is required to operate under a condition with 90V of input voltage at a primary side, and 80V of output voltage at a secondary side, it may be derived from a known transformer theory that, for a conventional transformer, the turn-ratio of primary winding and secondary winding should be 9:8. In this embodiment, when the number of turns of each winding of the first winding set 3 and each winding of the second winding set 4 is reduced to 1/4 of the original number of turns, the turn-ratio becomes (9/4):2.

Referring to FIG. 8 to FIG. 11, a winding approach of the first winding set 3 is to wrap each winding of the first winding set 3 around the winding support 2 to substitute the single winding at the primary side of a conventional transformer. This winding approach is similar to that of the first embodiment, and detailed descriptions of the same are omitted herein for the sake of brevity. The input terminals 31 of the four windings of the first winding set 3 are interconnected to form an input end 310 (see FIG. 7) as a primary side input terminal of the multiple winding transformer, and the output terminals 32 of the four windings of the first winding set 3 are interconnected to form an output end 320 (see FIG. 7) as the primary side output terminal of the multiple winding transformer. In this way, the non-integer turn-ratio, and symmetric distribution of the intensity of magnetic field are attainable, so the effects of balanced magnetic flux and reduced power consumption are achieved.

Based on the aforementioned calculation, when the turn-ratio of the first winding set 3 to the second winding set 4 is reduced to one fourth of the original turn-ratio of the conventional single winding, under the circumstance that the input electric current is the same, the power consumption of the second embodiment of the multiple winding transformer is reduced to one-sixteenth of that of the conventional transformer. The power consumption of the multiple winding transformer is significantly reduced, and overall energy conversion efficiency is improved.

To sum up, in these embodiments, by virtue of the N (N≥3) number of windings of the first winding set which are connected in parallel and are wound around the winding support of the multiple winding transformer, the overall energy conversion efficiency is improved. That is by virtue of the input terminal 31 of one of the windings of the first winding set 3 being spaced apart from the input terminal 31 of a next one of the windings by (360/N) degrees, and by virtue of the output terminal 32 of one of the windings of the first winding set 3 being spaced apart from the output terminal 32 of a next one of the windings by (360/N) degrees, when the number of turns of each winding of the multiple winding transformer is decreased to 1/N of the original number of turns, power consumption of the multiple winding transformer may be decreased to $1/N^2$ of original power consumption, so as to improve the overall conversion efficiency.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A multiple winding transformer comprising:

a core unit;

a first winding set including N (N≥3) number of windings sequentially and overlappingly wound around said core unit, each of said windings of said first winding set including an input terminal and an output terminal, said input terminal of one of said windings of said first winding set being spaced apart from said input terminal of a next one of said windings by (360/N) degrees, and said input terminals of said windings of said first winding set being interconnected to form an input end, said output terminal of one of said windings of said first winding set being spaced apart from said output terminal of a next one of said windings by (360/N) degrees, and said output terminals of said windings of said first winding set being interconnected to form an output end, said input terminal and said output terminal of each winding of said first winding set defining an angle of (360/N) degrees with respect to an axis of said core unit; and a second winding set including at least one winding wound around said core unit.

2. The multiple winding transformer according to claim 1, wherein said first winding set serves as a primary winding of the multiple winding transformer, and said second winding set serves as a secondary winding of the multiple winding transformer.

3. The multiple winding transformer according to claim 1, wherein said first windings set serve as a secondary winding of the multiple winding transformer, and said second winding set serves as a primary winding of the multiple winding transformer.

4. The multiple winding transformer according to claim 1, wherein said at least one winding of said second winding set is plural in number, said windings of said second windings set and said windings of said first windings set being wound around said core unit in a manner that a winding layer formed by one of said windings of the said second winding set is arranged between two winding layers respectively formed by two of said windings of said first windings set.

5. The multiple winding transformer according to claim 4, wherein, in an outward direction, said windings of said first winding set and said windings of said second winding set are arranged to alternate in order.

6. The multiple winding transformer according to claim 1, wherein said first winding set includes three of said windings, and wherein, for each of said windings of said first winding set, said input terminal and said output terminal of the winding define an angle of 120 degrees with respect to the axis of said core unit.

7. The multiple winding transformer according to claim 1, wherein said first winding set includes four of said windings, and wherein, for each of said windings of the said first winding set, said input terminal and said output terminal of the winding define an angle of 90 degrees with respect the axis of said core unit.

8. The multiple winding transformer according to claim 1, further comprising a winding support sleeved onto said core unit, and said windings of said first winding set and said at least one winding of said second winding set are wound around said winding support.

9. The multiple winding transformer according to claim 1, wherein each of said windings of said first winding set has a non-integer number of turns.

10. The multiple winding transformer according to claim 1, wherein said core unit includes two PQ-type cores which are correspondingly joined together.

11. The multiple winding transformer according to claim 1, wherein said axis of said core unit defines a longitudinal direction, and wherein said input terminal of a first of said windings of said first winding set is longitudinally aligned with said output terminal of a second of said windings of said first winding set different from the first of said windings, and said output terminal of said one of said windings of said first winding set is longitudinally aligned with said input terminal of a third of said windings of said first windings set different from the first and second of said windings.

* * * * *